United States Patent [19]

Caddick

[11] Patent Number: 4,616,588

[45] Date of Patent: Oct. 14, 1986

[54] WATER CRAFT AND METHOD FOR REMOVING WEEDS AND POLLUTANTS FROM NAVIGABLE WATERS

[76] Inventor: Mary J. Caddick, 74 Winifred Lane, Aughton, Ormskirk, Lancs, United Kingdom, L39 5DL

[21] Appl. No.: 689,940

[22] Filed: Jan. 9, 1985

[51] Int. Cl.[4] ..... B63H 25/06

[52] U.S. Cl. ..... 114/162; 56/8; 37/71; 440/88

[58] Field of Search ..... 37/71; 114/210, 162, 114/57; 440/88, 46, 71, 72; 56/8; 210/242.1; 212/192

[56] References Cited

U.S. PATENT DOCUMENTS

| | | | |
|---|---|---|---|
| 2,702,975 | 3/1955 | Friesen | 56/8 |
| 2,914,012 | 11/1959 | Godfrey et al. | 440/88 |
| 2,976,834 | 3/1961 | Waldron et al. | 440/88 |
| 3,113,389 | 12/1963 | Vuskovich | 56/8 X |
| 3,253,567 | 5/1966 | Patton, Jr. | 440/6 |
| 3,434,444 | 3/1969 | Caddick | 114/57 |
| 3,961,713 | 6/1976 | Stine | 212/192 |
| 4,070,978 | 1/1978 | Virgilio | 56/8 X |
| 4,416,106 | 11/1983 | Hawk | 56/8 |

FOREIGN PATENT DOCUMENTS

| | | | |
|---|---|---|---|
| 658016 | 10/1951 | United Kingdom | 440/72 |

*Primary Examiner*—Sherman D. Basinger
*Attorney, Agent, or Firm*—William E. Mouzavires

[57] ABSTRACT

A navigable water craft having a first tool mounted on the bow area for removing pollutants. The tool may be a basket or scoop which is mounted to be raised and lowered such as through hydraulic rams. Additionally, the basket may be mounted to be rotated about a vertical axis from side-to-side of the craft. At the stern area is mounted a weed removal tool preferably in the form of a triangular rigid structure which, in use, is lowered to be dragged on the sea bed by a line wound on a winch mounted on the craft. A control station including a operator's seat is located between the stern and bow forwardly of the winch which preferably is located in an open recessed compartment. To protect the steering rudder of the craft, a barrier is positioned at the stern to prevent the weed removal tool from engaging the rudder during raising or lowering of the tool. A roller is mounted across the stern area on the hull to facilitate movement of the weed removal tool over the stern area during raising or lowering of the tool. The craft is driven through an engine which is cooled through a closed circuit cooling system including a coolant tank located at the bottom of the hull and forming a part thereof so as to be submerged into the water in heat exchange contact with the water during use of the craft.

15 Claims, 9 Drawing Figures

FIG. 1
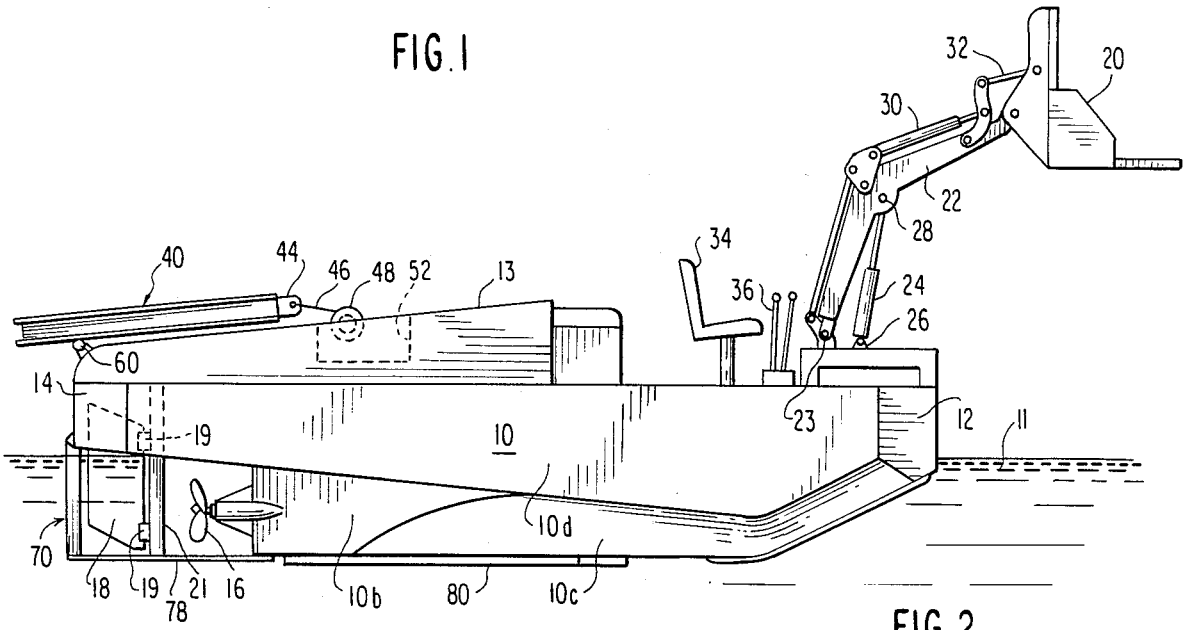
FIG. 2
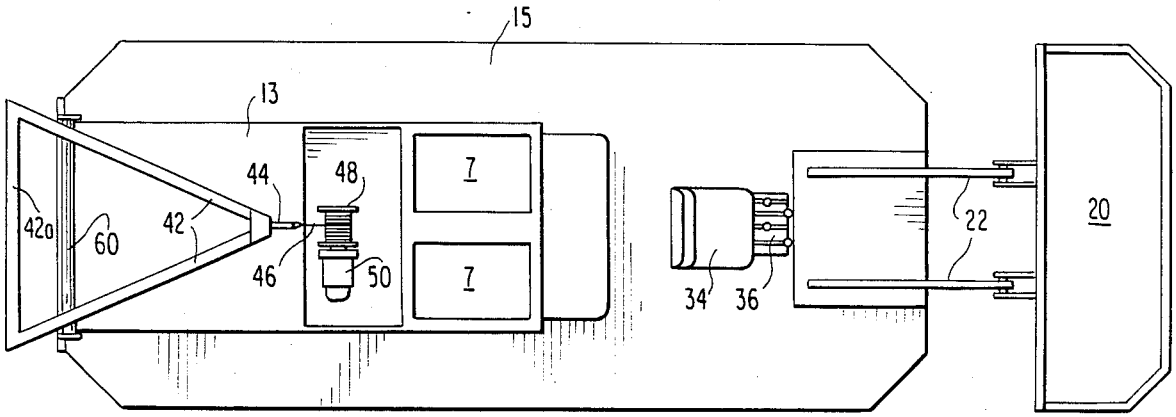
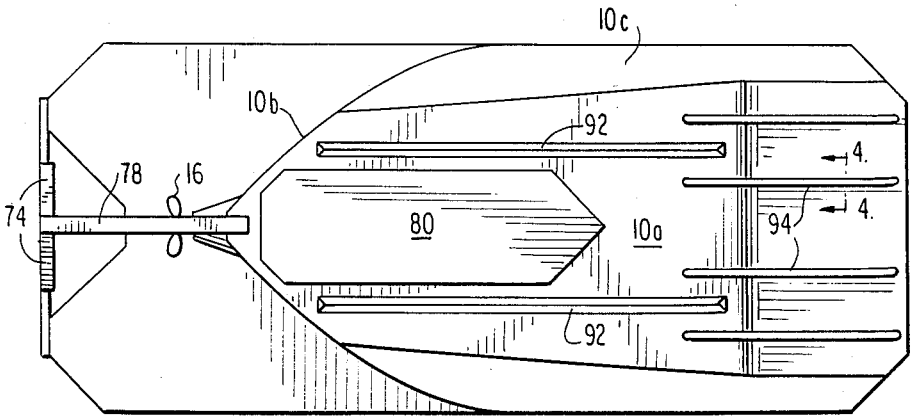
FIG. 3
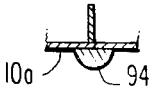
FIG. 4

FIG. 5
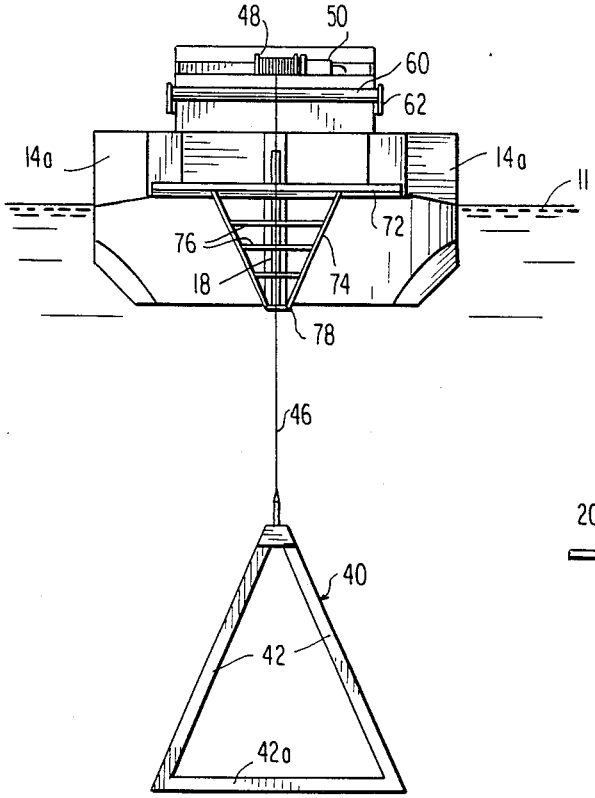
FIG. 9
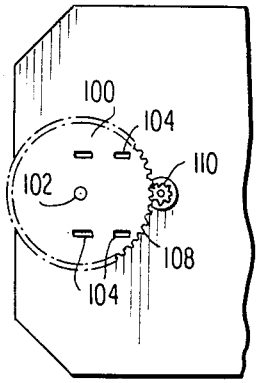
FIG. 8
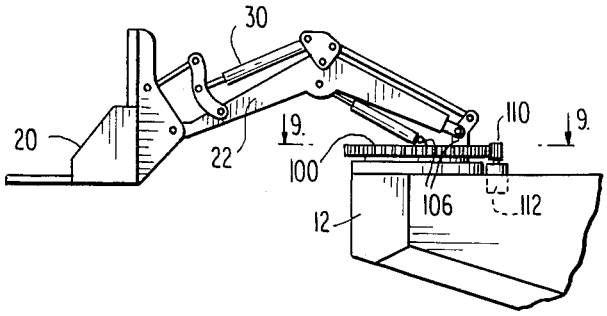
FIG. 6
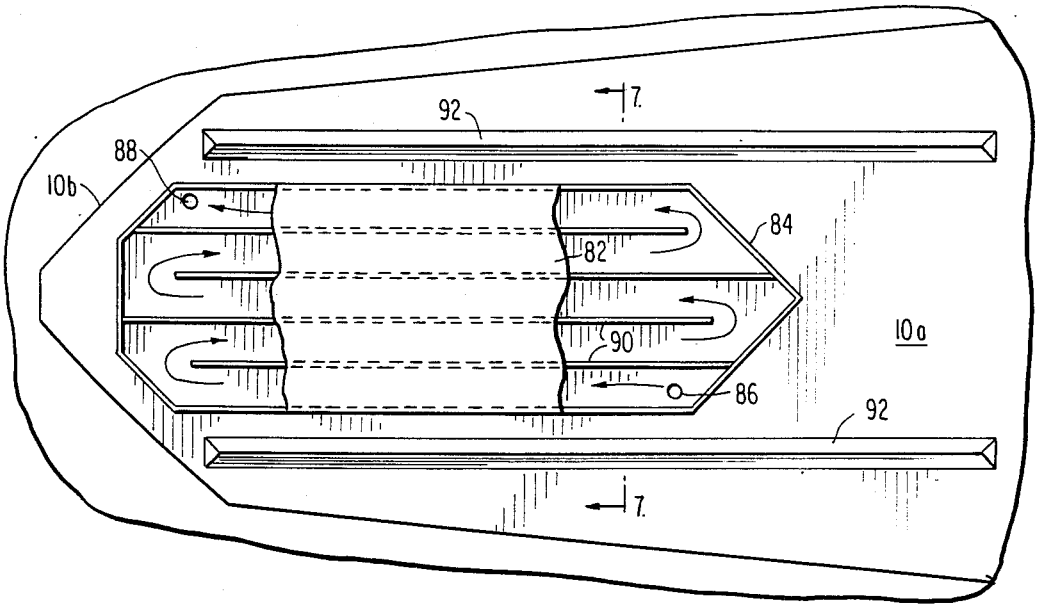
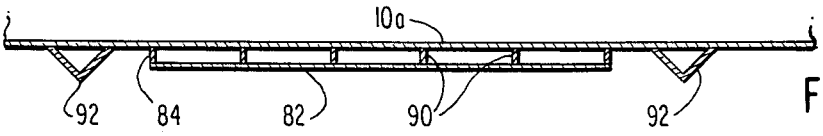
FIG. 7

WATER CRAFT AND METHOD FOR REMOVING WEEDS AND POLLUTANTS FROM NAVIGABLE WATERS

BACKGROUND OF INVENTION

In order to protect the environment of sea ports, harbors and waterways, navigable water craft have now been developed and placed into use for removing debris such as flotsam and jetsam which are removed by a basket or scoop mounted at the bow of the vessel to be movable under control of an operator into and out of the water to pick up the debris and dump it onto nearby barges or collection containers. Such craft are disclosed in U.S. Pat. Nos. 3,326,379 and 3,434,444 assigned to the same assignee as the subject application. Although such craft have been found to be quite effective in removing and handling floating debris, they still leave unattended the problem of removing weeds and other marine vegetation from the beds of waterways, canals, channels, etc. Such vegetation have been known to render waterways unnavigable and in other situations, it has caused serious blockage of the water flow.

Another deficiency of conventional pollutant control water craft is that their cooling systems for the engines which propel the craft are susceptible to blockage by debris and marine vegetation due to the fact that the craft operates in polluted or debris-ridden areas.

OBJECTS OF THE PRESENT INVENTION

An object of the present invention is to provide a navigable water craft capable of ripping out weeds or other marine vegetation from the beds of navigable waters. Additionally, it is an object to provide such water craft that is also capable of removing flotsam, jetsam and other floating debris from navigable waters.

Another object of the present invention is to provide a novel method of removing weeds and other marine vegetation from the beds of navigable waters. Included herein is such a method which utilizes a navigable water craft.

A further object of the present invention is to provide a novel weed removal tool and system that may be used on navigable water craft for removing weeds and marine vegetation from the beds of navigable waters.

A still further object is to provide a navigable water craft that has a novel arrangement of tools and accessories for removing floating debris and rooted weeds from navigable waters. Included herein is such a water craft that may be easily operated by but a single person.

Another object of the present invention is to provide such a navigable water craft that is steered through a rudder that is protected from debris in the water as well as the weed removal operations conducted through the use of the water craft.

A still further object of the present invention is to provide such a water craft that incorporates a novel cooling system for the engine which propels the water craft and which cooling system is not susceptible to blockage by debris or other foreign matter existing in the water.

Another object of the present invention is to provide a navigable water craft having a tool that may be raised and lowered relative to the water and rotated about a vertical axis for the purpose of removing flotsam, jetsam and other debris or pollutants from navigable waters.

SUMMARY OF INVENTION

In one aspect, the present invention provides a method and apparatus for ripping out weeds and other vegetation from the beds of waterways by utilizing a weed removal tool that is lowered from a navigable craft into the water and dragged along the bed as the craft is propelled forwardly. The tool is attached to a line wound about a motorized winch mounted on the craft. In the preferred embodiment, the tool is lowered and raised from the stern of the craft, and a barrier is mounted at the stern to protect the rudder from the tool as the latter is raised and lowered.

The craft of the present invention also contains a tool in the form of a scoop or basket mounted on the bow to be raised and lowered into the water for removing flotsam, jetsam and other debris and pollutants from the water. The basket is also mounted to be rotated about a vertical axis to position the basket to either side of the craft or any points therebetween. A control station is located intermediate the bow and the stern from which a single operator may control the various operations of the craft including navigation of the craft.

In addition, the craft includes a closed circuit cooling system for cooling the engine. The cooling system includes a coolant tank located at the bottom of the hull and forming a part thereof so as to be submerged into the water in heat exchange contact with the water. Other features of the invention will be described below.

DRAWINGS

Other objects and advantages of the present invention will be apparent from the following more detailed description taken in conjunction with the attached drawings in which:

FIG. 1 is a side elevational view of a water craft embodying the present invention shown in the water and with its front end scoop raised;

FIG. 2 is a top plan view of the craft;

FIG. 3 is a bottom plan view of the craft;

FIG. 4 is a fragmental cross-sectional view taken generally along lines 4—4 of FIG. 3;

FIG. 5 is a rear end view of the craft shown with its weed removal tool lowered;

FIG. 6 is an enlarged fragmental bottom plan view of the craft and with parts broken away to show the inside of a cooling tank included in the engine cooling system;

FIG. 7 is a fragmental cross-sectional view taken generally along lines 7—7 of FIG. 6;

FIG. 8 is a fragmental side elevational view at the bow of a craft showing a modification utilized to revolve the scoop about a vertical axis; and FIG. 9 is a top plan view of the craft shown in FIG. 8 with its scoop removed to show its turntable.

DETAILED DESCRIPTION

Referring now to the drawings in detail, there is shown for illustrative purposes only a water craft embodying the present invention. Referring to FIG. 1, the craft includes a hull generally designated 10 formed from steel plate or other suitable sturdy material, a bow area 12 and a stern area 14. The hull bottom 10*a* is generally flat and terminates short of the stern to provide a recessed understern where a propeller 16 is mounted to be driven by a suitable engine not shown. Rearwardly of the propeller 16 is mounted a rudder 18 for steering the craft. The lower sides 10*c* of the hull slant downwardly and upwardly from vertical upper sides 10*d* and at their rear converge inwardly at 10*b* to the longitudinal centerline or beam of the craft.

Referring to FIG. 1, at the bow area 12 on the upper deck is mounted a tool in the form of a scoop or basket 20 for removing from the water flotsam and jetsam or other debris and pollutants. Scoop 20 is pivotally mounted to a pair of booms 22 whose bases are pivoted at 23 to the top deck. The booms 22 are raised or lowered by hydraulic rams 24 anchored at 26 to the deck and connected to the midsections of the booms at 28. Scoop 20 is pivotable relative to the booms 22 by means of hydraulic rams 30 and a linkage 32 connecting the rams 30 to the scoop 20. The scoop 20 and its mounting booms 22 and hydraulic rams 24 and 30 are well-known as indicated in the aforementioned U.S. Pat. Nos. 3,326,379 and 3,434,444 and therefore need no further description.

Navigation of the craft including control of the engine and rudder 18 as well as the scoop 20 is achieved by an operator at a central station located behind the scoop where an operator's seat 34 and controls 36 are located. Behind the control station the craft has a raised deck 13 extending to the stern along the longitudinal central section of the craft leaving walkways 15 on opposite sides thereof on the main deck. A pair of hatches 7 are provided on the raised deck to provide access to the engine forwardly of a recessed winch compartment to be described below.

In accordance with the present invention, there is mounted on the raised deck 13 at the stern area, a weed removal tool generally designated 40. In the preferred embodiment, tool 40 includes three heavy rigid members 42 formed, for example, from steel I beams welded or bolted together to form a triangular structure whose opposite sides are equal in length. In its idle position shown in FIGS. 1 and 2, tool 42 lies in a generally horizontal plane on the raised deck 13 at the stern area with its forward apex generally aligned above the longitudinal centerline of the craft and with its rearmost side 42*a* projected beyond the stern and extending at right angles to the longitudinal centerline of the craft as best shown in FIG. 2. Projecting from the forward apex of the tool 40 is a tie plate 44 to which is tied a line or cable 46 whose opposite end is wound about a rotatable winch 48 mounted to extend transversely across the centerline of the craft preferably in a recess 52 located in the upper deck 13. The upper end of the recess 52 is open but its opposite sides are closed. Winch 48 is driven by a motor 50 through controls at the control station. Rotation of the winch 48 in one direction will pay out the line 46 to lower the tool 40 from the stern into the water as illustrated in FIG. 5 to engage along the bed to rip out weeds and other vegetation as the craft is propelled forwardly. Rotation of the winch 48 in the opposite direction will, of course, raise the tool 40 onto the raised deck 13 into the idle position shown in FIGS. 1 and 2. To facilitate movement of the tool as well as to guide the tool in movement to and from its idle position, a roller 60 is mounted for rotation across the stern on the raised deck 13. Roller 60 engages the undersurface of the sides 42 of the tool and is provided with an outer layer of rubber or other flexible and resilient material.

In order to protect the rudder 18 from the tool 40 during raising, lowering or operation of the tool 40, a barrier generally designated 70 is provided at the lower stern behind the rudder 18. In the preferred embodiment, the barrier 70 includes steel bars 74 fixed to and diverging downwardly away from a steel cross bar 72 fixed across the stern as shown in FIG. 5. A plurality of cross struts 76 also formed from steel bars are fixed such as by welding to and between bars 74 at vertically spaced locations as shown in FIG. 5. The bottom of the barrier 70 is anchored to the bottom of the hull by means of a rigid steel bar 78 extending along the longitudinal centerline of the craft as best shown in FIGS. 1 and 3. As shown in FIG. 1, the rudder 18 is mounted for pivotal movement in bearings 19 fixed to a post 21 whose upper end is fixed to the hull and whose lower end is secured to bar 78. As shown in FIG. 5, the barrier provides a cage over the rudder 18 preventing the weed removal tool 40 or the tow line 46 from engaging the rudder during use of the weed removal tool. Since the weight of the barrier 70 may be on the order of 500 pounds buoyancy, tanks may be provided in the hull at the stern at 14*a* shown in FIG. 5.

The engine which drives the propeller 16 is conventional, however, a closed circuit coolant system is utilized to cool the engine. In accordance with another feature of the invention, a coolant tank generally designated 80 is provided at the bottom of the hull as shown in FIGS. 3, 6 and 7 to lie in heat exchange relationship with the water 11. In the preferred embodiment, coolant tank 70 has a generally rectangular cross section including a flat bottom wall 82 spaced from the bottom wall 10*a* of the hull and side walls 84 extending between walls 10*a* and 82 to enclose a space for receiving coolant which is admitted into the tank and discharged therefrom through ports 86 and 88 formed in the hull wall 10*a*. The coolant which may be fresh water or other coolant liquid is circulated throughout the coolant tank from the inlet port 86 to the outlet port 88 by means of longitudinal channels formed in the tank by flat partition walls 90 fixed to and between walls 10*a* and 82. Partition walls 90 provides a continuous serpentine path for the coolant to enhance heat exchange with the external sea water through the coolant tank walls and partitions. It will be seen that the use of a closed circuit coolant system and the placement of the coolant tank 70 avoids the problem attending conventional cooling systems that utilize sea water as the coolant and which are susceptible to clogging by debris, weeds and other foreign matter existing in the sea or body of water in which the craft is operating.

In the preferred embodiment, the coolant tank is made of steel plate or other material of similar strength and is placed to extend longitudinally on the bottom of the hull so as to be centered and symmetrical with respect to the longitudinal centerline of the craft as shown in FIG. 6. In order to provide a degree of protection to the coolant tank 70 as well as to reinforce the bottom of the hull, a pair of stiffening ribs 92 are fixed to the bottom wall 10*a* of the hull to extend longitudinally thereof on opposite sides of the coolant tank 60. Reinforcing ribs 92 may take the form of structural steel members such as angle irons, and they are dimensioned to extend downwardly beyond the plane of the bottom wall 82 of the coolant tank as shown in FIGS. 3 and 7. The bottom wall of the hull at the bow area is also reinforced with ribs 94 as shown in FIGS. 3 and 4.

Referring now to FIGS. 8 and 9, the bow portion of a modified craft is shown on which the scoop 20 is mounted to also be movable about a vertical axis 102 located on the longitudinal centerline of the craft to enable the scoop to be moved to either side of the craft or any points therebetween. In the specific embodiment shown, this is accomplished through a turntable 100 mounted for rotation about its center on a shaft 102. The boom 30 and its associated hydraulic rams 24 and 30 are mounted in apertures 104 in the turntable 100 through ears 106 fixed within apertures 104. Turntable 100 is provided with gear teeth on its periphery in mesh with a drive pinion 110 driven by a hydraulic motor 112 or any other suitable means under the control of the operator at the control station. Rotation of pinion 110 will, of course, rotate turntable 100 in either of two directions at the selection of the operator. In addition and as described above, the scoop may be raised or lowered through the boom 22 and its ram 24 and may be pivoted relative to the boom 22 through ram 30. Other than the turntable 100 and its associated gearing and pinion 110, the craft of FIGS. 8 and 9 is the same as the craft disclosed in FIGS. 1 to 7 and described above.

What is claimed is:

1. A navigable water craft including a hull and having a stern area including a stern and a rudder, a weed removal tool for removing weeds and other marine vegetation, said tool being located at the stern area, means on the craft for lowering the tool into the water at the stern for dragging the tool along a water bed as the craft is navigated through water and for raising the tool onto the stern area, means fixed to the stern and located behind the rudder and extending substantially to the depth of the rudder for protecting the rudder from engagement by the tool, buoyancy means at the stern area for compensating for the weight of the means for protecting the rudder, means including an engine for driving the craft, and a cooling tank having a closed coolant circuit for cooling the engine, said cooling tank being located on the bottom of the hull to be submerged in the water to contact the same when the craft is in use, said hull including a generally flat bottom wall, said cooling tank including a bottom wall spaced from and fixed to the flat bottom wall of the hull to enclose a space sealed from the sea water, said cooling tank further including means fixed to and between the bottom wall of the hull and the bottom wall of the tank forming a continuous serpentine flow path for coolant within said space sealed from the sea water, said bottom wall of the tank having an unobstructed external surface exposed directly to the sea water to promote heat exchange between the sea water and coolant within the tank.

2. The water craft defined in claim 1 wherein said means fixed to and between the bottom wall of the hull and the bottom wall of the tank include partition walls spaced from each other to define a continuous serpentine path for the coolant in the tank.

3. The water craft defined in claim 2 wherein said bottom wall of said tank is made from steel plate.

4. The water craft defined in claim 1 wherein said hull has a recess at a lower part of the stern, said rudder is located in said recess, and wherein said means for protecting the rudder includes a first mounting member fixed across the stern above said recess, a second mounting member fixed to the hull below said recess, and barrier means fixed to and extending between said mounting members.

5. A navigable water craft comprising in combination, a hull having a bow area including a bow and a stern area including a stern and a rudder, a first tool mounted at the bow area for removing pollutants from the water at the bow, said tool including a boom pivotally mounted on the bow area to be raised and lowered for positioning said tool, a weed removal tool at the stern for removing weeds or other marine vegetation from the bed of the water, means for lowering said weed removal tool into the water at the stern and for raising the tool onto the stern area, means fixed to the stern and located behind the rudder and extending substantially to the depth of the rudder for protecting the rudder from engagement by the weed removal tool, an engine for driving the craft, and a cooling tank having a closed coolant circuit for cooling the engine, said cooling tank being located on the hull to be at least partially submerged in the water to contact the same when the craft is in use.

6. The water craft defined in claim 5 further including a control station located intermediate the bow and stern for controlling operation of said tools.

7. The craft in claim 6 further including a recessed compartment located between the stern and the control station, and said means for lowering the tool includes a winch located in said compartment and a line having one end connected to the weed removal tool and an opposite end wound about the winch.

8. The water craft defined in claim 5 further including means for raising and lowering said first tool and for revolving the first tool about a vertical axis.

9. The craft defined in claim 8 wherein said means for revolving the first tool about a vertical axis includes a turn table mounted at the bow area for rotation about a vertical axis, and means for rotating the turn table in either direction about said vertical axis.

10. The water craft defined in claim 5 wherein said hull has a generally flat bottom wall, said cooling tank includes a generally flat bottom wall spaced from and fixed to the flat bottom wall of the hull to enclose a space sealed from the sea water, said cooling tank further includes means fixed to and between the bottom wall of the hull and the bottom wall of the tank forming a continuous serpentine flow path for coolant within said space sealed from the sea water, and said bottom wall of the tank has an unobstructed external surface exposed directly to the sea water to promote heat exchange between the sea water and coolant within the tank.

11. The water craft defined in claim 10 wherein said means fixed to and between the bottom wall of the hull and the bottom wall of the tank include partition walls spaced from each other to define a continuous serpentine path for the coolant in the tank.

12. The water craft defined in claim 10 wherein said bottom wall of said tank is made from steel plate.

13. The water craft defined in claim 5 further including buoyancy tanks in the hull at opposite sides of the stern for compensating for the weight of the means for protecting the rudder.

14. The water craft defined in claim 5 wherein said hull has a recess at a lower part of the stern, said rudder is located in said recess, and wherein said means for protecting the rudder includes a first mounting member fixed across the stern above said recess, a second mounting member fixed to the hull below said recess, and barrier means fixed to and extending between said mounting members.

15. A navigable water craft for removing pollutants from navigable waters, the craft comprising in combination with a hull having a bottom wall, an engine for propelling the craft, and a closed circuit cooling system for cooling the engine, said cooling system including a cooling tank located on the hull to be in heat exchange relation with the sea water, said tank enclosing a space sealed from the sea water and including an inlet port and an outlet port for circulating coolant in a closed circuit extending through the tank, said cooling tank including a generally flat bottom wall spaced from and fixed to the bottom wall of the hull to enclose a space sealed from the sea water, said cooling tank further including means fixed to and between the bottom wall of the hull and the bottom wall of the tank forming a continuous serpentine flow path for coolant within said space sealed from the sea water, said bottom wall of the tank having an unobstructed external surface exposed directly to the sea water to promote heat exchange between the sea water and coolant within the tank, and wherein there is further included rib members extending along the bottom of the hull on opposite sides of the coolant tank, said rib members extending vertically below the lowermost level of the tank.

* * * * *